US007213725B2

(12) United States Patent
Peterson et al.

(10) Patent No.: US 7,213,725 B2
(45) Date of Patent: May 8, 2007

(54) COMBINATION DISPENSER AND FRAME

(75) Inventors: Christopher Peterson, 57 Colebrook Rd., Norfolk, CT (US) 06058; Daniel James Lewis, Ridgewood, NJ (US)

(73) Assignee: Christopher Peterson, Norfolk, CT (US)

( * ) Notice: Subject to any disclaimer, the term of this patent is extended or adjusted under 35 U.S.C. 154(b) by 110 days.

(21) Appl. No.: 10/716,737

(22) Filed: Nov. 18, 2003

(65) Prior Publication Data

US 2005/0103800 A1 May 19, 2005

(51) Int. Cl.
*B67D 5/06* (2006.01)

(52) U.S. Cl. ..... 222/78; 222/183; 40/722

(58) Field of Classification Search ..... 222/78, 222/183; 40/725, 722
See application file for complete search history.

(56) References Cited

U.S. PATENT DOCUMENTS 2,144,551 A * 1/1939 Skolnick ..... 40/722
3,276,428 A * 10/1966 Burch ..... 119/257
5,301,444 A * 4/1994 Horiuchi ..... 40/426
5,363,984 A * 11/1994 Laird, III ..... 221/24
6,296,151 B1 * 10/2001 Chen ..... 222/183
6,415,739 B1 * 7/2002 Orendorff et al. ..... 40/722

* cited by examiner

*Primary Examiner*—Philippe Derakshani
(74) *Attorney, Agent, or Firm*—Wolf Block Schorr & Solis-Cohen LLP

(57) ABSTRACT

A dispenser for dispensing materials is provided including a container for holding the material to be dispensed, a plurality of frame portions for holding decorative items, locking apparatus for locking the frame portions to the container, and a dispensing means for dispensing materials from the container. The dispenser also includes a base for receiving the container and frame portions, a memory device for playing a sound when the dispenser is removed from the base, and a switch for activating the memory device when the container is removed from the base.

21 Claims, 3 Drawing Sheets

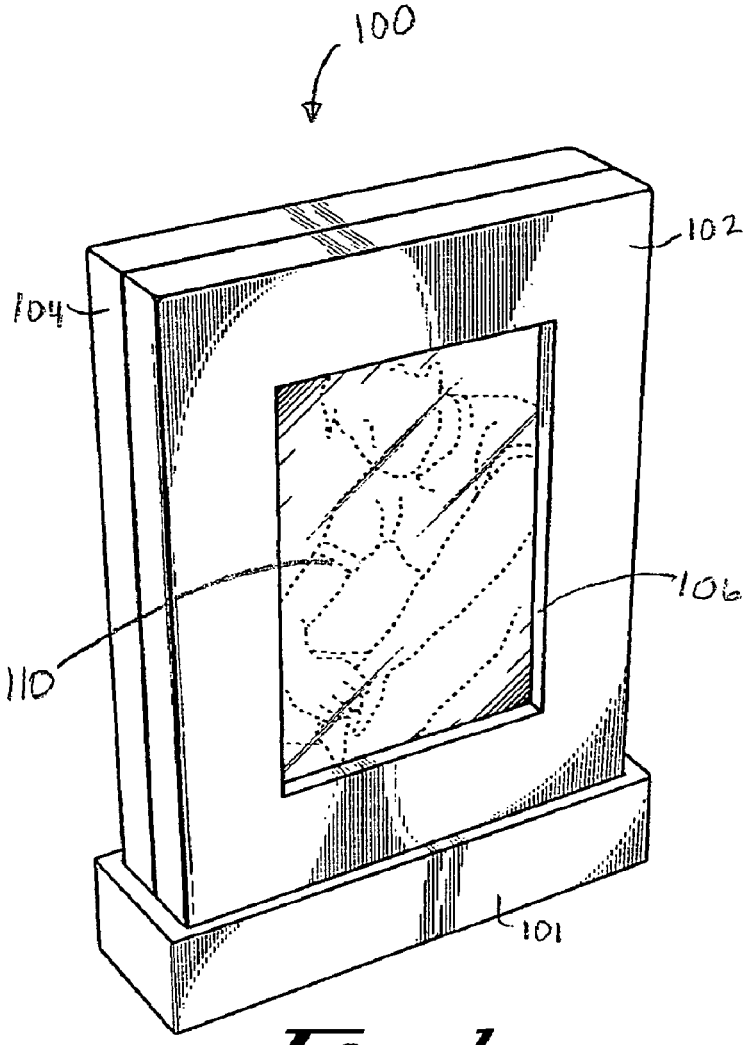
Fig. 1
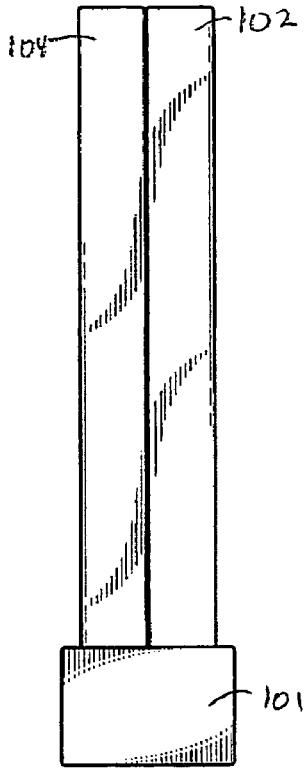
Fig. 2
Fig. 3
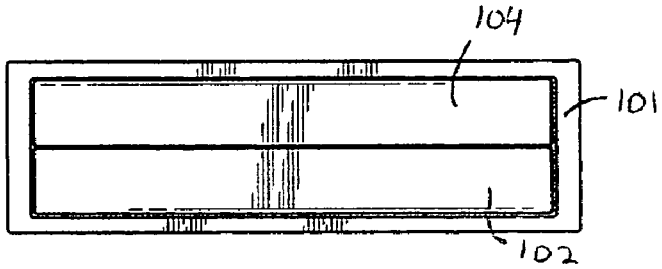
Fig. 4
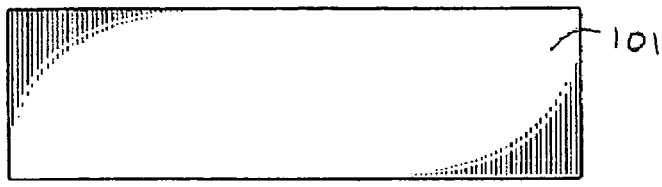

COMBINATION DISPENSER AND FRAME

FIELD OF THE INVENTION

The present invention relates to a dispensing device which achieves a decorative effect.

BACKGROUND OF THE INVENTION

A conventional dispensing bottle has a functional purpose without any decorative effect. Moreover, after a period of use the bottle is exhausted, and the material that was dispensed can usually not be replaced.

It is known in the field of bottles to provide a range of packaging for dispensing bottles. They may be decorative or strictly functional bottles which are called "refills" and have no decoration. These refill bottles are intended to be housed in a decorative case.

OBJECTS AND SUMMARY OF THE INVENTION

It is an object of the present invention to provide a dispenser and easily detachable frames for holding media whereby the assembly of the perfume bottle can be changed to enhance the appearance.

In order to achieve this object and others, a dispenser for dispensing materials is provided including a container for holding the material to be dispensed, a plurality of frame portions for holding decorative items, locking apparatus for locking the frame portions to the container, and a dispensing means for dispensing materials from the container. The dispenser also includes a base for receiving the container and frame portions, a memory device for playing a sound when the dispenser is removed from the base, and a switch for activating the sound device when the container is removed from the base.

The plurality of frames each contain an aperture and each aperture contains an inner edge operable to lock onto the container.

The frames each contain clips to lock onto each other and hold the container. The dispenser includes a dispensing mechanism and the base includes an opening for receiving the dispensing mechanism. The dispenser may also include a cap for receiving the container and frame portions and a cover for covering the aperture may be included.

DESCRIPTION OF THE DRAWINGS

The invention, together with further objects and advantages thereof, may best be understood by reference to the following description taken in conjunction with the accompanying drawings wherein like reference numerals identify like elements.

FIG. 2 is a side view of the dispenser in accordance with the invention;

FIG. 3 is a top view of the dispenser in accordance with the invention;

FIG. 4 is a bottom view of the dispenser in accordance with the invention;

FIG. 7 is a perspective exploded view of the dispenser in accordance with the invention.

DETAILED DESCRIPTION OF THE INVENTION

Figure 5:
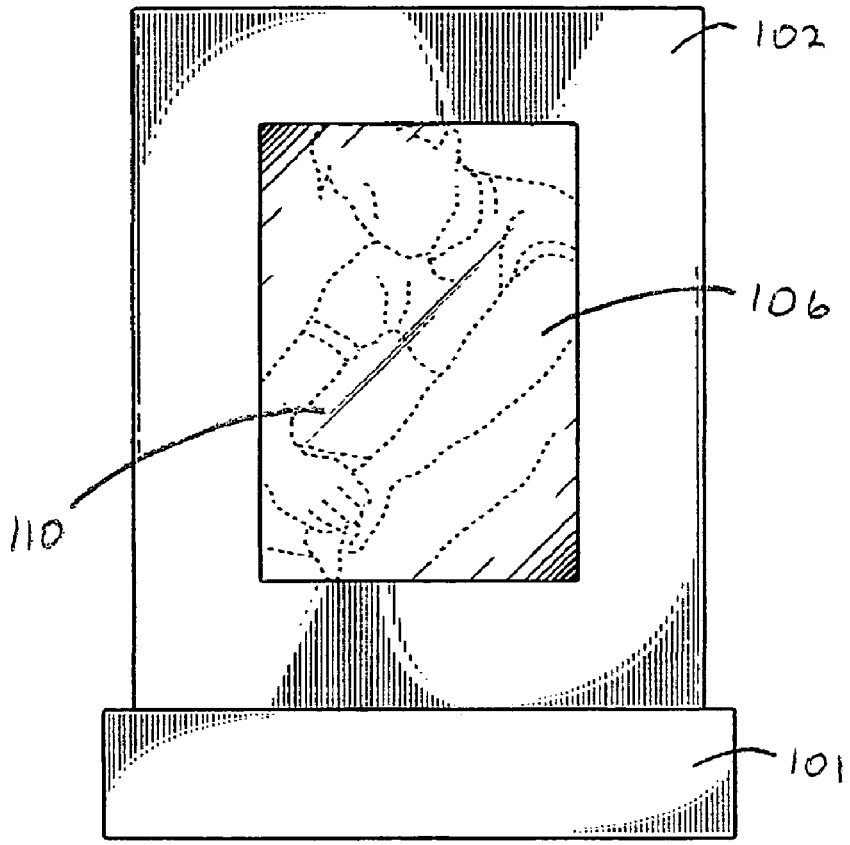
FIG. 5 is a front view of the dispenser in accordance with the invention.
Figure 6:
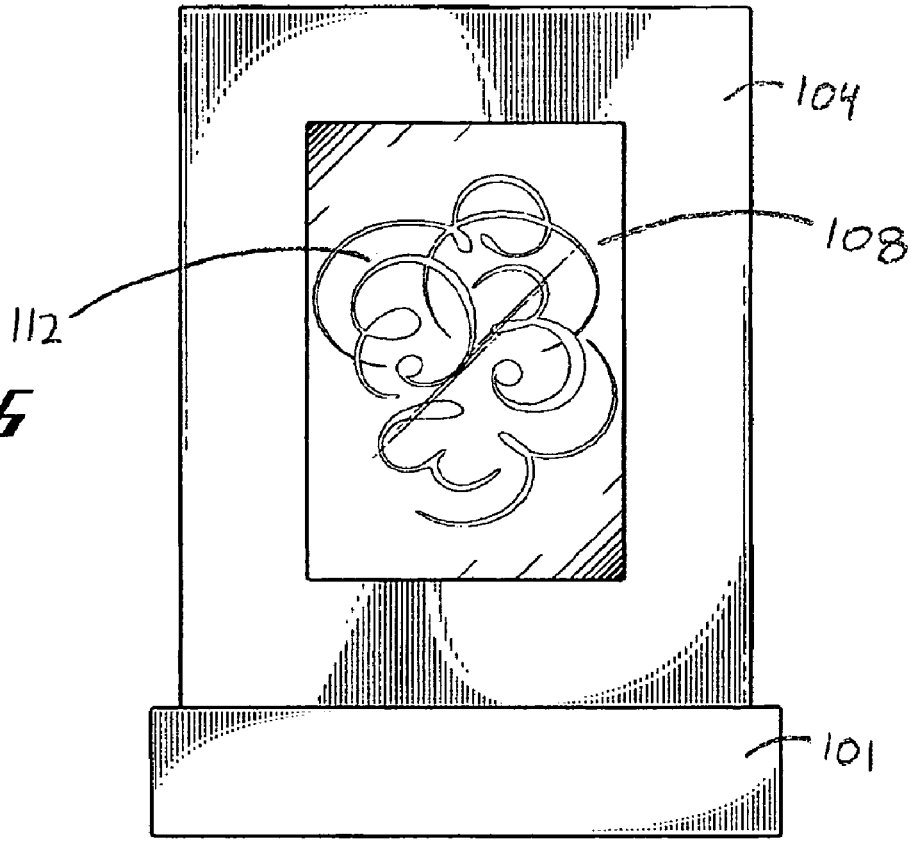
FIG. 6 is a rear view of the dispenser in accordance with the invention.
Figure 1:
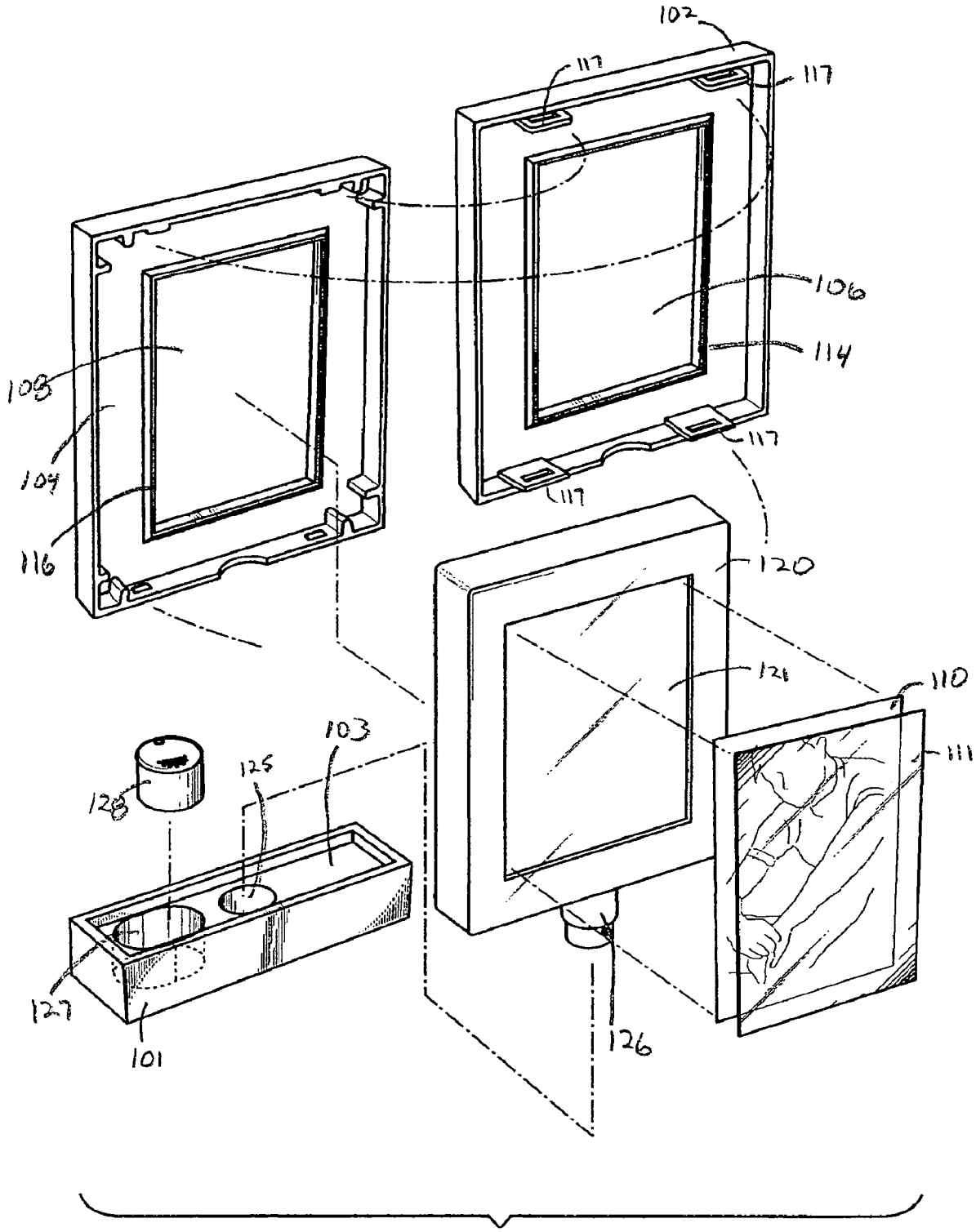
FIG. 1 is a upwards and partial side perspective view of the dispenser in accordance with the invention.

Referring to FIG. 1 through FIG. 6, The dispenser 100 of the present invention is shown. The dispenser 100 includes a base 101, a first frame portion 102 and a second frame portion 104. Disposed in the first frame portion 102 is a first aperture 106 and disposed in the second frame portion 104 is a second aperture 108. Shown positioned in the first aperture 106 is a first media image 110 and shown positioned in the second aperture 108 is the second media image 112.

As shown in FIG. 7, the dispenser 100 also includes a dispenser bottle 120 for holding a liquid or other substance to be dispensed. The dispenser bottle 120 is provided with a dispensing mechanism 126. The dispenser bottle 120 further includes matching size cavities 121 formed on each side of the dispenser bottle 120.

The base 101 is rectangular in shape and solid except for a rectangular portion 103 for receiving the frame portions 102 and 104. The base 101 also is formed with an opening 125 and another larger opening 127. The opening 125 is of such a size to receive the dispensing mechanism 126 of dispenser bottle 120. Opening 127 is adapted to receive a having a memory device capable of playing sounds 128. This may be triggered by a switch which may be activated by light. The memory device may be a sound chip.

The first frame portion 102 and the second frame portion 104 are rectangular in shape and hollow. Disposed around the first aperture 106 is a first inner edge 114 and disposed around the second aperture 108 is a second inner edge 116. The first frame portion 102 and the second frame portion 104 are interlocking but detachable from each other. Their respective apertures 106 and 108 form frames. The first inner edge 114 and the second inner edge 116 are adapted to extend into the matching size cavities 121 of dispenser bottle 120 and lock to hold in place the first media image 110 and second media image 112.

The locked combination of the frame portions 102 and 104 along with the dispenser bottle 120 rest on the base 101. The dispenser bottle 120 rests in a position such that its dispensing mechanism 126 is at the bottom of the bottle and sits in the opening 125.

The first and second frame portions 102 and 104 are rectangular frames with the first and second apertures 106 and 108 having a length and width that is less than the length and width of the first and second frame portions 102 and 104. On the edges of the first and second frame portions 102 and 104, clips 117 are provided. Clips 117 attache the first and second frame portions 102 and 104 together while the first and second aperture inner edges 114 and 116 lock onto the matching size cavities 121 of the dispenser bottle 120. The first and second frame portions 102 and 104 when locked together form a rectangular cavity for holding the dispenser bottle 120. According to the above arrangement, when assembled, first and second frame portions 102 and 104 together are respectively assembled with the dispenser bottle 120.

The first and second media images 110 and 112 are placed in the matching size cavities 121 of dispenser bottle 120. Then a transparent covering 111 is placed over the first and second media images 110 and 112. The transparent covering 111 has a length and width which is greater than the length and width of the first and second apertures 106 and 108, but less than the length and width of the first and second frame portions 102 and 104. This allows the first and second frame portions 102 and 104 to hold the transparent covering in place. This, in turn holds the first and second media images 110 and 112 against the matching size cavities 121. The first and second frame portions 102 and 104 are locked to the dispenser bottle 102 by the first and second aperture inner edges 114 and 116 locking into the matching size cavities 121 of the dispenser bottle. The first and second frame portions 102 and 104 are also held together by the clips 117 locking the first and second frame portions 102 and 104 together against the dispenser bottle 120.

After the first and second frame portions 102 and 104 and the dispenser bottle 120 are locked together, they can then be set on top of the base 101 such that the dispensing mechanism 126 is inserted into opening 125 and the lower edged of the first and second frame portions 102 and 104 are inserted into the rectangular portion 103 of base 101. When the first and second frame portions 102 and 104 together with the dispenser bottle 120 having the dispensing mechanism is lifted off of the base 101, light enters the memory device 128 and a sound plays.

It should be noted that the first and second media images may be any image whether two or three dimensional.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The above embodiment is only used to illustrate the present invention, not intended to limit the scope thereof. Many modifications of the above embodiment can be made without departing from the spirit of the present invention.

We claim:

1. A dispenser for dispensing materials, comprising:

a container for holding the material to be dispensed;

a frame apparatus for interchangeably holding at least one planar decorative item against at least one side of said container, said frame apparatus coupled to said container;

locking means for locking said frame apparatus to said container; and a dispensing means for dispensing said materials from said container.

2. The dispenser of claim 1, further comprising a base for receiving said container and frame apparatus.

3. The dispenser of claim 2, farther comprising a memory device for playing a sound when said dispenser is removed front said base.

4. The dispenser of claim 3, further comprising a switch for activating said memory device when said container is removed from said base.

5. The dispenser of claim 1, wherein said frame apparatus comprises a plurality of frame portions and wherein said plurality of frames portions each contain an aperture.

6. The dispenser of claim 5, wherein said aperture contains an inner edge operable to lock onto said container.

7. The dispenser of claim 6, wherein said container contains matching size cavities operable to mate with said inner edge of said apertures.

8. The dispenser of claim 1, wherein said frame apparatus comprises a plurality of frame portions and wherein said plurality of frames portions each contain clips to lock onto each other and contain said container.

9. The dispenser of claim 2, wherein said container comprises a dispensing mechanism.

10. The dispenser of claim 9, wherein said base includes an opening for receiving said dispensing mechanism.

11. The dispenser of claim 1, further comprising a cap for receiving said container and frame portions.

12. The dispenser of claim 6, and further comprising a cover for covering said aperture.

13. The dispenser of claim 1, wherein said frame apparatus comprises two frame portions.

14. The dispenser of claim 1, wherein said frame apparatus is square.

15. The dispenser of claim 1, wherein said frame apparatus is rectangular.

16. The dispenser of claim 1, wherein said frame apparatus is circular.

17. The dispenser of claim 1, wherein said frame apparatus is triangular.

18. The dispenser of claim 1, wherein said frame apparatus is of an irregular shape.

19. The dispenser of claim 5, wherein the aperture is the same shape as said frame portions.

20. The dispenser of claim 5, wherein the aperture is a different shape from the shape of said frame portions.

21. The dispenser of claim 1, wherein said container is a bottle.

* * * * *